United States Patent [19]

Barry et al.

[11] 4,365,226

[45] Dec. 21, 1982

[54] PLUG-IN TYPE FUSE

[75] Inventors: Leon G. Barry; Willis E. Rieman, both of Shelby, N.C.

[73] Assignee: Fasco Industries, Inc., Boca Raton, Fla.

[21] Appl. No.: 237,253

[22] Filed: Feb. 23, 1981

[51] Int. Cl.[3] ..... H01H 85/02

[52] U.S. Cl. ..... 337/198; 337/269; 337/295

[58] Field of Search ..... 337/197, 198, 260, 264, 337/268, 269, 271, 290, 295

[56] References Cited

U.S. PATENT DOCUMENTS 4,023,265 5/1977 Aryamane ..... 337/264 X 4,131,869 12/1978 Schmidt et al. ..... 337/264

*Primary Examiner*—George Harris

*Attorney, Agent, or Firm*—Shlesinger, Fitzsimmons & Shlesinger

[57] ABSTRACT

This two-piece fuse comprises a generally rectangular plastic, dielectric housing, and a one-piece wire conductor. The conductor is folded into generally W-shaped configuration, and its inverted, V-shaped center section is inserted into a central recess in the bottom of the housing in such manner that its two, spaced, V-shaped legs are bent around the grooved, rounded ends of a pair of rigid web sections which project from the underside of the housing. Opposite ends of the folded wire are secured in a pair of spaced openings in the housing so that the two V-shaped legs of the wire are supported in a common plane by two web sections of the housing. The diameter of the wire is greater than the depth of the groove in each web section so that portions of the wire legs project out of the grooves for engagement with contacts when the leg sections of the wire are inserted into a cooperating female receptacle.

8 Claims, 10 Drawing Figures

PLUG-IN TYPE FUSE

BACKGROUND OF THE INVENTION

This invention relates to electrical fuses, and more particularly to a novel plug-in type fuse suitable for low voltage applications, and designed to be releasably pluggable into a female receptacle. In addition this invention relates to a method of making such fuses.

There are a number of plug-in type fuses that are currently employed for protecting low voltage circuits in automobiles and the like. These plug-in fuses have to a great extent replaced the older, glass tube fuses of the type in which a thin, wire fuse element is enclosed in glass tube, and is soldered or otherwise secured at opposite ends to metal caps that are secured over opposite ends of the tube.

Typically the plug-in type fuse (see, e.g., U.S. Pat. No. 3,909,767) includes a plastic housing containing a thin, metal fuse element, which is secured at opposite ends to a pair of flat, blade-shaped terminals that project out of the housing to be insertable into a matching female receptable. Ideally such fuses are designed so as to be easily insertable into a panel in side-by-side relation to protect a plurality of low voltage circuits, and to be readily accessible in the event they need be replaced.

A major disadvantage of these blade-type fuses is that they are relatively expensive to manufacture, and generally cannot be calibrated once they have been assembled. Efforts have been made to improve upon fuses of this type by using a single, one-piece metal fuse element having a pair of flat terminals interconnected by an integral, necked-down section, as disclosed for example, in the above-noted U.S. Pat. No. 3,909,767. An advantage of this construction is that the one-piece fuse elements can be stamped from a metal plate and then secured in respective plastic housings. The fuses are calibrated at the time that the elements are stamped from the metal plate, simply by predetermining the size of the necked-down portion which will be formed by the stamping operation. Among the disadvantages of this construction, however, is that the resultant fuse is rather expensive. Moreover, once the element has been stamped from a plate, its rating has been set, and further calibration thereof is not possible.

SUMMARY OF THE INVENTION

This invention obviates disadvantages of known fuses of the type described by employing as the fuse element, proper, a conventional piece of electrically conductive wire, which initially is bent into the form of a "W". The two upstanding legs of the "W" are then inserted into a pair of spaced, parallel openings formed in a generally rectangular plastic housing or holder, which has in its center a central recess for accommodating the upwardly bowed or inverted V shaped section of the "W" shaped wire. The two, spaced curved lower ends of the "W" seat in arcuate recesses formed in the peripheries of a pair of integral skirts or web sections which extend beneath the lower end of the plastic holder; and the terminal ends of the upstanding leg sections of the "W" are bent over into recesses in the top of the holder to secure the fuse element in the holder. After the wire fuse element and the holder are assembled, an instrument or a laser beam is employed carefully to neck down or otherwise reduce the cross sectional area of the central portion of the fuse element. This controlled reduction in the cross sectional area of the element operatively calibrates the fuse for rupture at a desired current rating.

The diameter of the wire which is employed to form the "W" shaped fuse element is larger in diameter than the arcuate recess or trough formed in the supporting skirt portions of the holder. Consequently, when these round, lower end portions of the "W" shaped element are inserted into registering aperatures in conventional female receptacles of the type used on the fuse panels in automobiles and the like, the rounded projections on the wire fuse element will be properly connected in the circuit that is to be protected.

THE DRAWINGS

Figure 1:
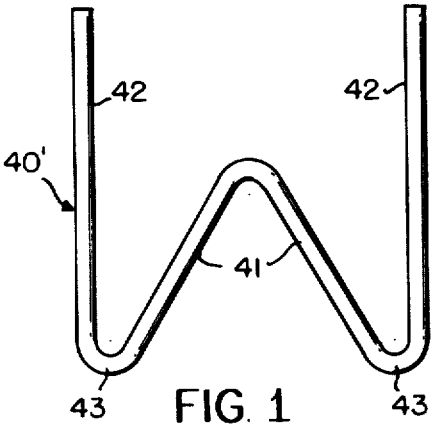
FIG. 1 is a front elevational view of a cylindrical fuse wire of the type employed in this invention, and illustrating the "W"-type configuration into which the wire is bent prior to its assembly and clibration in the fuse housing.
Figure 2:
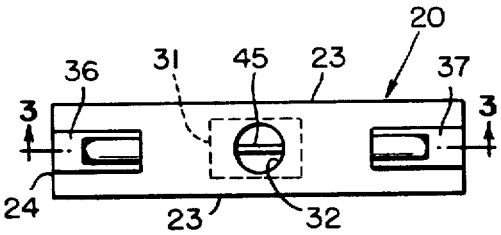
FIG. 2 is a plan view of a fuse made according to one embodiment of this invention, and showing the fuse housing and the wire of FIG. 1 as it appears after it has been inserted into the fuse housing.
Figure 4:
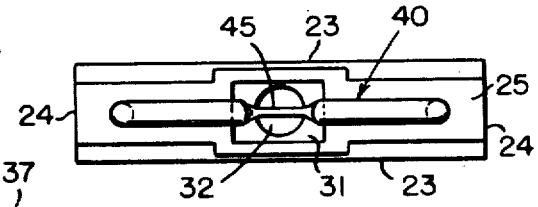
FIG. 4 is a bottom plan view of this fuse, but showing the fuse housing as it appears before being pinched welded to close the lower end of its arc chamber.

Referring now to the drawings by numerals of reference, and first to the fuse shown in FIGS. 1 to 6, 20 denotes generally a one-piece, plastic dielectric fuse housing comprising a nearly rectangular body section having a plain, flat upper surface 22, plain, parallel, recessed side surfaces 23, plain, parallel end surfaces 24, and a flat bottom surface 25 that extends parallel to the upper surface 22. Integral with and projecting downwardly from the housing surface 25 at equispaced points intermediate the ends of the housing are two, flat, web-shaped projections or skirts 27, the lower ends of which are rounded as at 28. Each of the projections 27 has in its outer peripheral edge a longitudinally extending, arcuate recess 29 which is generally concave in cross section.

Housing 20 has in the center thereof a deep, rectangular socket or recess 31, which opens at its lower end on the bottom surface 25 of the housing, and which opens at its upper end through a reduced-diameter window or port 32 onto the upper housing surface 22. Recess 31 is flanked by two, spaced, parallel openings or bores 34 and 35, which extend vertically through housing 20 adjacent opposite ends thereof to open at their upper ends on notches or recesses 36 and 37, respectively, which are formed in the upper surface 22 of the housing adjacent opposite ends thereof. As shown more clearly in FIG. 4, the lower ends of the bores 34 and 35 open on, and register with, the concave surfaces 29 formed in the peripheral surfaces of the projections 27.

Secured in the fuse housing 20 is a calibrated, nearly "W"-shaped conductor, which is denoted generally at 40 in FIGS. 3 to 6. This conductor is produced from a conventional, cylindrical wire 40' (FIG. 1), the cross sectional area of which, prior to calibration, is essentially the same throughout its length. Prior to its insertion into the housing 20, wire 40' is bent into its generally W-shaped configuration as shown in FIG. 1. In this form the wire is inserted upwardly into the bottom of the housing 20 so that the inverted, V-shaped center portion thereof, which is formed by the intersecting leg sections 41, projects upwardly into the central recess 31 in the bottom of the housing, and so that its outer, upstanding parallel leg sections 42 pass upwardly through theopenings 34 and 35 in the housing. This operation places the spaced, rounded, lower ends 42 of the "W"-shaped conductor over the matching, lower, rounded ends 28 of the webs 27, thus limiting the extent to which the member 40' can be inserted into the housing.

Figure 3:
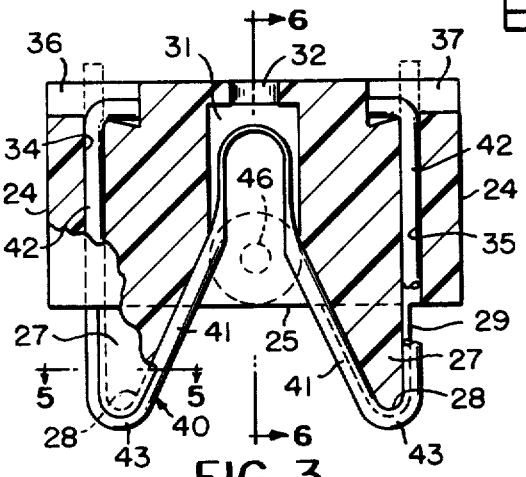
FIG. 3 is a front elevational view of this fuse taken along the line 3—3 in FIG. 2 looking in the direction of the arrows, and with a portion of the fuse wire being cut away for purposes of illustration.
Figure 5:
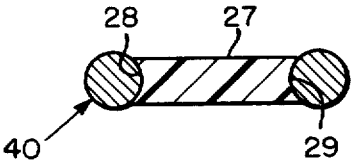
FIG. 5 is a sectional view of this fuse taken generally along the line 5—5 in FIG. 3 looking in the direction of the arrows.
Figure 6:
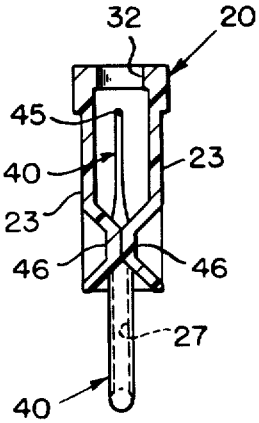
FIG. 6 is a sectional view taken generally along the line 6—6 in FIG. 3 looking in the direction of the arrows.

At this time the upper ends of the leg sections 42 project slightly above the housing as shown by the broken lines in FIG. 3. In order to secure the wire element 40' to housing 20, the two upper ends of the leg sections 42 are then peaned or otherwise bent over inwardly against the bottom of the respective recesses 36 and 37, thereby drawing the lower, rounded ends 43 of the conductor snugly into the arcuate recesses 29 formed in the outer edges of the webs or skirt portions 27 on the housing. The web sections 27 thus engage the inner peripheral surfaces of the two registering sections 43 of the wire lead 40', so that these lower ends of the lead are operatively secured by the webs 27 against movement relative to the housing 20. As shown more clearly in FIG. 5, the overall thickness of each web section 27 (for example 0.02 inches) is slightly less than the diameter of the cylindircal fuse wire 40' (for example 0.025 inches). The curved outer surfaces of the lower portions 43 of the wire 40' thus project slightly beyond the opposed, plane surfaces of the supporting web sections 27 for the purposes noted hereinafter.

After the fuse wire 40' has been secured in the housing 20 as noted above, the wire is calibrated by inserting a calibrating probe or plunger into the lower end of the opening 31 in the housing and urging it upwardly against the transversely extending portion of the fuse wire 40' in order to cause this central portion of the fuse wire to neck down, or otherwise to have its cross sectional area reduced, as shown for example at 45 in FIGS. 2 to 4 and 6. During this operation the fuse wire 40' is connected in a circuit which can monitor, for example, the resistance to current flow through the wire. When the resistance reaches a predetermined value, the probe can be removed from the housing to prevent any further necking down of the wire section 45, at which point the fuse wire 40 will have been calibrated to burn out or melt at its reduced section 45, when the current flow in the wire exceeds a predetermined value.

After calibration has taken place the fuse wire 40 can be secured against further movement in the housing 20, for example by pinch welding together opposed sections of the housing as at 46 (FIG. 6) between legs 41 of the fuse wire adjacent the lower end of chamber 31.

In use, the fuse is adapted to be plugged into a mating female receptable of conventional construction, and which may form part of a fuse panel in an automobile, or the like. The fuse is inserted into the circuit by gripping the housing 20 manually, and inserting the lower, rounded ends 43 of the fuse wire into the female receptacle. Since the diameter of the fuse wire 40 in these areas is slightly larger than the thickness of the supporting web sections 27, the outer peripheral surfaces of the wire 40 will be free to engage and contact the corresponding circuit contacts in the female receptacles. If the associated circuit becomes overloaded—i.e., the current flow through the fuse wire 40 exceeds the value for which it has been calibrated—the thin, neck section 45 will fuse or melt suddenly, thereby opening the circuit through the fuse. Whether or not the fuse has blown or burned out, can be determined visually merely by observation through the window or opening 32 in the top wall of the fuse housing. In practice this opening can be covered or filled with a transparent material to prevent any injury from sputtering or arcing, which might take place when the fuse blows. Of course instead of employing the window 32 it would be possible to manufacture the entire housing 20, or at least portions thereof, out of a transparent plastic material so that it would be a simple matter to view the fusible section of the fuse wire located in chamber 31.

A major advantage of a fuse of the type described, as for example in comparison with the fuse disclosed in the above-noted U.S. Pat. No. 3,909,767, is that the overall fuse consists of only two elements—i.e., a single plastic housing and a single, one-piece wire fuse, thereby considerably simplifying its manufacture and calibration. In the case of the above-noted prior art patent, it is necessary to employed a fuse link which has a specific thickness and a specific shape or configuration for each current rating and with no opportunity to compensate on an individual fuse basis for metallurgical or dimensional variations in the fuse link, as fabricated.

In addition, since these prior art fuse materials are blanked form a strip of metal, as opposed to being formed from a single piece of wire, the physical quantity of metal fuse material required for such prior art fuses is substantially greater than that needed to produce the novel fuse disclosed above.

Still another major advantage of this novel fuse is that it can be calibrated after assembly, and merely by elongating or otherwise narrowing the cross sectional area of the central or inverted V portion of the fuse wire until the desired increase in electrical resistance is obtained. There is a direct correlation between the electrical current that the fuse wire can carry without blowing, and the cross sectional area of the fuse wire at the desired area of eventual failure. Each fuse is thus individually calibrated, with the same type or size of fuse wire being capable of accommodating a very wide range of fuse ratings, simply by controlling the extent to which the fuse wire is stretched or necked down at finel calibration. Thereafter by pinch welding or otherwise securing together opposed portions of the housing 20 between the leg sections 41 of the fuse, these legs are prevented from accidentally touching each other after the fuse has blown.

Moreover, in view of the unique design of the fuse housing 20, it is possible readily to secure the wire 40' in the housing merely by inserting its two parallel legs 42 into the registering openings 34 and 35, and then bending or peaning over the upper ends of these leg sections into the recesses 36 and 37. This operation not only secures the fuse wire in the housing but also operates to draw the rounded, lower end portions 43 of the wire sungly into the supporting grooves 29 in the web sections 27. Thus both the assembly and the calibration of the fuse can be effected extremely rapidly and with a minimum amount of handling.

Figure 7:
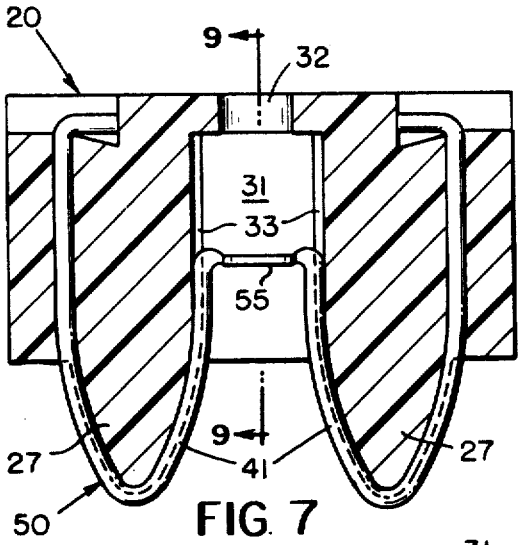
FIG. 7 is a sectional view generally similar to FIG. 3, but illustrating a modified form of this fuse.
Figure 9:
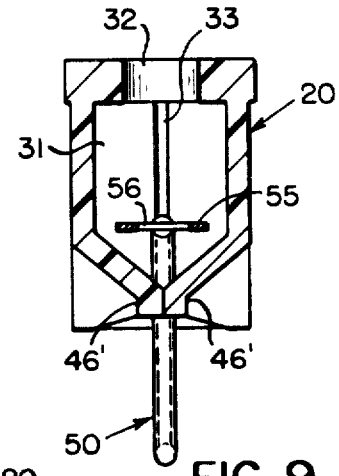
FIG. 9 is a sectional view taken generally along the line 9—9 in FIG. 7 looking in the direction of the arrows.
Figure 8:
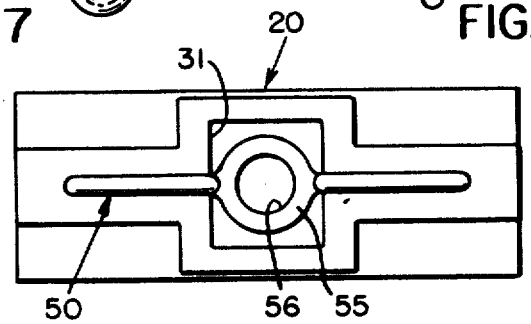
FIG. 8 is a bottom plan view of this modified form of fuse.

Referring now to the embodiment shown in FIGS. 7 to 9, wherein like numerals are employed to denote elements similar to those employed in the first embodiment, 20 denotes generally a plastic fuse housing, which is similar to that shown in FIGS. 1 to 6, except that in this embodiment a pair of elongate grooves 33 are formed in the opposed side walls of bore 31 to guide the opposed leg sections 41 of a modified fuse wire denoted generally at 50.

The fuse wire 50 is generally similar to the wire 40, except that its central portion 55, instead of being necked down as at 45 in the first embodiment, is now flattened and has therein a central opening 56, which extends transversely across the housing bore 31 intermediate the ends of the latter. The wire section 55 can be flattened and punctured either before or after assembly into the housing 20. Moreover, after the fuse wire 50 has been secured in the housing 20 still further calibration of the fuse can be effected, for example by making the hole 56 incrementally larger by use of a tapered reamer, or the like, until the desired resistance or cross sectional area of the flattened section 55 has been reached. Instead of a reamer, of course, it would also be possible to use a laser beam to burn a gradually larger hole 56 through the ribbon section 55 until the desired resistance is reached. In any case, a major advantage of this construction is that the actual calibration (the final calibration) of the fuse can be effected after the assembly of the wire 50 into the housing 20.

As in the preceeding embodiment, after the wire 50 has been calibrated opposite sides of the housing at the bottom of bore 31 can be pinch welded or otherwise secured together as at 46' (FIG. 9).

Figure 10:
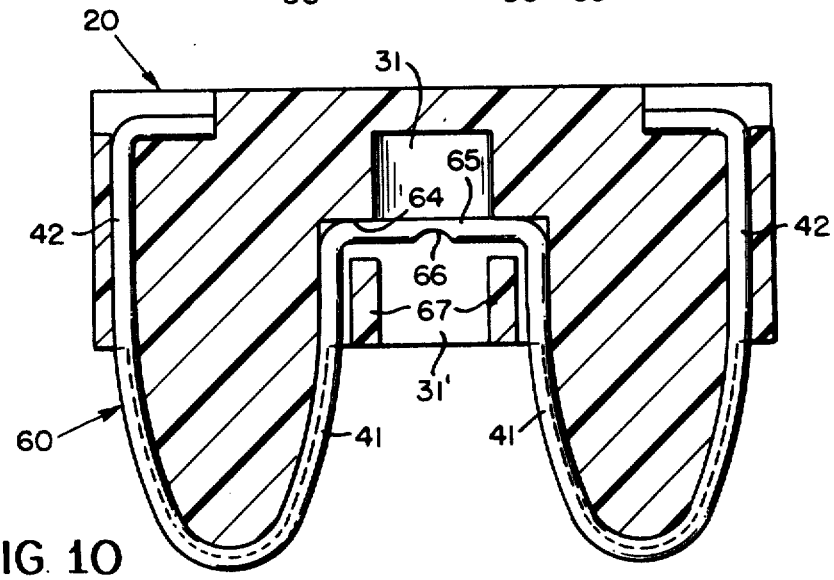
FIG. 10 is a sectional view generally similar to FIGS. 3 and 7, but illustrating still a further embodiment of this invention.

Referring now to FIG. 10, the fuse shown in this figure comprises a transparent plastic housing 20 which, although otherwise similar to the previously discussed housings, does not require or have in its upper end the opening 32; and its central bore or opening 31 has an enlarged section 31' at its lower end, thereby forming intermediate the ends of the bore an annular shoulder 64. In this embodiment a generally W-shaped fuse wire 60 is secured in the housing 20 to have its center section 65 extend transversely across the housing bore 31. After the wire 60 has been secured in the housing its transverse section 65 has its cross sectional area gradually reduced by use of a laser beam, which may be directed through the side of the optically transparent housing 20 gradually to remove part of the transverse wire section 65, for example as at 66, whereby the wire is caused to have its cross sectional area reduced until the desired resistance of the wire 60 is achieved.

After the calibration of the fuse 60, or for that matter before calibration, if desired, the lower end 31' of bore 30 may be pinch welded or otherwise closed in a couple of places as at 67.

From the foregoing it will be apparent that the instant invention provides an extremely simple method of producing accurate and inexpensive fuses for controlling current flow in low voltage circuits, such as for example electric circuits in automobiles and the like. By starting out with a conventional, cylindrical wire conductor, and bending the wire into a desired shape so that it can be inserted into a one-piece plastic housing, it is possible substantially to eliminate many of the more complicated operations and tools heretofore required to produce plug-in type fuses. Since the fuse wires for a vast number of fuses can be selected from the same batch of wire, the continuity of fuse quality is materially increased, as is the reliability and ease with which such fuses can be calibrated. Accuracy in the rating of the fuse can also be considerably increased since calibration of the fuse is essentially the last step conducted in the manufacture of the fuse, except for the slight pinch welding which can be used to close the lower end of the arc chamber in which the fusible section of the fuse wire is housed.

While in the embodiments disclosed herein it has been suggested that the fuse be bent into the configuration of a W, it will be readily apparent that other wire configurations can be employed to produce the two spaced, plug-in sections (43) of the fuse, as well as the point intermediate the ends of the fuse where its cross sectional area is reduced to produce the desired current control. Also, while the wire fuse element has been illustrated as being circular in cross section, it will be understood that one-piece conductors of other cross sectional configuration may be employed without departing from this invention.

Moreover, while only certain embodiments of the invention have been illustrated and described in detail herein, it will be apparent that this invention is capable of still further modification, and that this application is intended to cover any such modifications as may fall within the scope of one skilled in the art or the appended claims.

What we claim is:

1. A plug-in type fuse, comprising an electrically non-conductive housing having therein a recess, a continuous, substantially cylindrical one-piece wire fuse element secured to said housing, said wire element being bent intermediate its ends to form a central section thereof which extends into said recess and a pair of spaced leg sections which extend from said central section to the exterior of said housing for insertion into a matching female fuse receptacle, a portion of said central section of said element in said recess being non-cylindrical and reduced in cross sectional area as compared to the remaining portion of said element, and rigid support means projecting from said housing and having therein shallow grooves in which said spaced leg sections are seated to be supported thereby for insertion into said receptacle, said leg sections having at least portions thereof projecting from said grooves to make electrical contact with contacts in said female receptacle, when said leg sections are inserted thereinto.

2. A plug-in type fuse as defined in claim 1, wherein each of said grooves is segmental cylindrical in cross section and has a radius of curvature slightly smaller than the radius of said remaining portion of said fuse element.

3. A plug-in type fuse as defined in claim 1, wherein said support means includes a thin, flat web projecting from said housing and having in its outer edge one of said grooves, said web having a thickness slightly less than the diameter of said remaining portion of said element.

4. A plug-in type fuse as defined in claim 3, wherein a second, similar web projects from said housing in spaced, generally parallel relation to the first-named web, and also has in its outer edge one of said grooves, said webs project from said housing adjacent opposite sides of said recess, and said grooves in said webs open on said recess in registry with the leg sections that project exteriorly of said housing.

5. A plug-in type fuse as defined in claim 4, wherein the ends of said webs remote from said housing are rounded, and each of said leg sections is curved intermediate its ends around the rounded end of the associated supporting web.

6. A plug-in type fuse as defined in claim 5, wherein said wire fuse element is bent into a generally W-shaped configuration with the inverted V-shaped center section thereof projecting into said recess in said housing, and with the two, spaced, rounded lower ends of the W-shaped element being positioned in the grooved, rounded ends of said spaced webs, and the spaced, terminal ends of said W-shaped element being secured in a pair of spaced openings formed in said housing adjacent opposite sides of said recess.

7. A plug-in type fuse as defined in claim 1, wherein said housing is made from a transparent, plastic material.

8. A plug-in type fuse as defined in claim 1, wherein said recess is closed at one end and opens in part at its opposite end on the exterior of said housing, and said housing has a window therein at the closed end of said recess to permit said reduced cross sectional area of said element to be viewed from the exterior of said housing.

* * * * *